US007475443B2

(12) United States Patent
Wang

(10) Patent No.: US 7,475,443 B2
(45) Date of Patent: Jan. 13, 2009

(54) PRESSURE SWITCH APPLICABLE FOR AN INFLATABLE BODY

(76) Inventor: Cheng-Chung Wang, 9F, No. 24, Songjhih Rd., Sinyi Dist., Taipei (TW)

( * ) Notice: Subject to any disclaimer, the term of this patent is extended or adjusted under 35 U.S.C. 154(b) by 315 days.

(21) Appl. No.: 11/472,460

(22) Filed: Jun. 21, 2006

(65) Prior Publication Data

US 2006/0291964 A1 Dec. 28, 2006

(30) Foreign Application Priority Data

Jun. 23, 2005 (CN) ..... 2005 1 0035450

(51) Int. Cl.
*A47C 27/08* (2006.01)
*H01H 35/40* (2006.01)

(52) U.S. Cl. ..... 5/713; 5/655.3; 200/82 R; 200/83 J

(58) Field of Classification Search ..... 5/713, 5/710, 706, 655.3; 200/82 R, 83 J
See application file for complete search history.

(56) References Cited

U.S. PATENT DOCUMENTS

| | | | | |
|---|---|---|---|---|
| 4,220,836 | A | 9/1980 | Hersey | 200/83 |
| 4,524,255 | A | 6/1985 | Haag | 200/83 |
| 4,939,321 | A | 7/1990 | Tanaka et al. | 200/83 |
| 4,998,087 | A | 3/1991 | Boulanger | 337/354 |
| 5,198,631 | A | 3/1993 | Hogue et al. | 200/83 |
| 5,308,939 | A | 5/1994 | Sasaki | 200/83 |
| 5,672,049 | A | 9/1997 | Ciurlo | 417/44.1 |
| 5,814,779 | A | 9/1998 | Verras et al. | 200/83 |
| 5,932,857 | A | 8/1999 | Stander et al. | 200/83 |
| 6,329,619 | B1 | 12/2001 | Koguchi | 200/83 |
| 6,522,252 | B2 | 2/2003 | Horibe et al. | 340/544 |
| 6,525,286 | B2 | 2/2003 | Koguchi et al. | 200/834 |
| 6,990,700 | B2 * | 1/2006 | Chung | 5/713 |
| 7,020,921 | B2 * | 4/2006 | Wang | 5/713 |
| 7,256,361 | B1 | 8/2007 | Lee | 200/83 |
| 7,365,277 | B2 | 4/2008 | Wang | 200/82 |
| 2007/0006387 | A1 * | 1/2007 | Wang | 5/713 |

* cited by examiner

*Primary Examiner*—Alexander Grosz
(74) *Attorney, Agent, or Firm*—Alan Kamrath; Kamrath & Associates PA

(57) ABSTRACT

A inflatable product for an inflatable body includes a casing with an airway adapted to communicate with an interior of the inflatable body, and a resilient element movably positioned inside the casing to define with the casing a space therebetween. An on/off switch is adapted to connect to an air pump,A driving element is movably positioned inside the casing to be in response to the movement of the resilient element so as to selectively activate the on/off switch to activate the air pump. A recoil element is positioned around the driving element and has a distal end which is abutted against the resilient element, The spring is compressed/decompressed when the resilient element moves in response to pressure inside the inflatable body so that activation/deactivation of the on/off switch is controlled via the movement of the resilient element as well as the compression of the spring.

25 Claims, 25 Drawing Sheets

PRESSURE SWITCH APPLICABLE FOR AN INFLATABLE BODY

BACKGROUND OF THE INVENTION

1. Field of the Invention

The present invention relates to a pressure switch and, more particularly, to a pressure switch adapted to be driven by pressure inside an inflatable body so as to selectively and automatically activate operation of a pump to inflate the object and to maintain the pressure inside the inflatable body within a predetermined range.

2. Description of the Prior Art

There are various inflatable bodies in our daily life, such as mattresses, sofas and animal figured toys. Due to temperature factors around the inflatable body, loadfactors on top of the inflatable body and sealing effect inside the inflatable body, all these inflatable bodies may require inflation from time to time, for safety and comfort reasons, after continuously using the inflatable body for a period of time. Because there is no monitoring device to keep track of pressure variations inside the inflatable body, every now and then the user will have to check the inflatable body's pressure to ensure that the inflatable body is suitable for use. If the inflatable body's pressure is low or is not suitable for use, the user will have to inflate the inflatable body. Currently, every inflation process is processed manually. Therefore, the operator needs to constantly inflate the inflatable body to maintain pressure inside the inflatable body and to provide comfort to the user, which is quite labor inefficient.

To overcome the shortcomings, the present invention provides an improved pressure switch to mitigate the aforementioned problems.

SUMMARY OF THE INVENTION

The primary objective of the present invention is to provide an improved pressure switch to selectively and automatically activate/deactivate operation of a pump to start/stop pumping the inflatable body to maintain pressure of the inflatable body within a predetermined range.

Another objective of the present invention is to provide a load adjusting assembly inside the pressure switch to adjust pressure sensitivity of the pressure switch so as to allow the pressure to be adapted to fit different applications.

A still further objective of the present invention is to provide an exchanging chamber inside the casing of the pressure switch of the present invention and having a sliding block movably received inside the exchanging chamber to communicate the interior of the pressure switch with the interior of the inflatable body to allow inflation/deflation to the inflatable body via a pump.

A further objective of the present invention is that the sliding block is driven by a server motor inside the casing of the pressure switch of the present invention via a worm shaft directly connected to a gear which is integrally formed with the sliding block.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
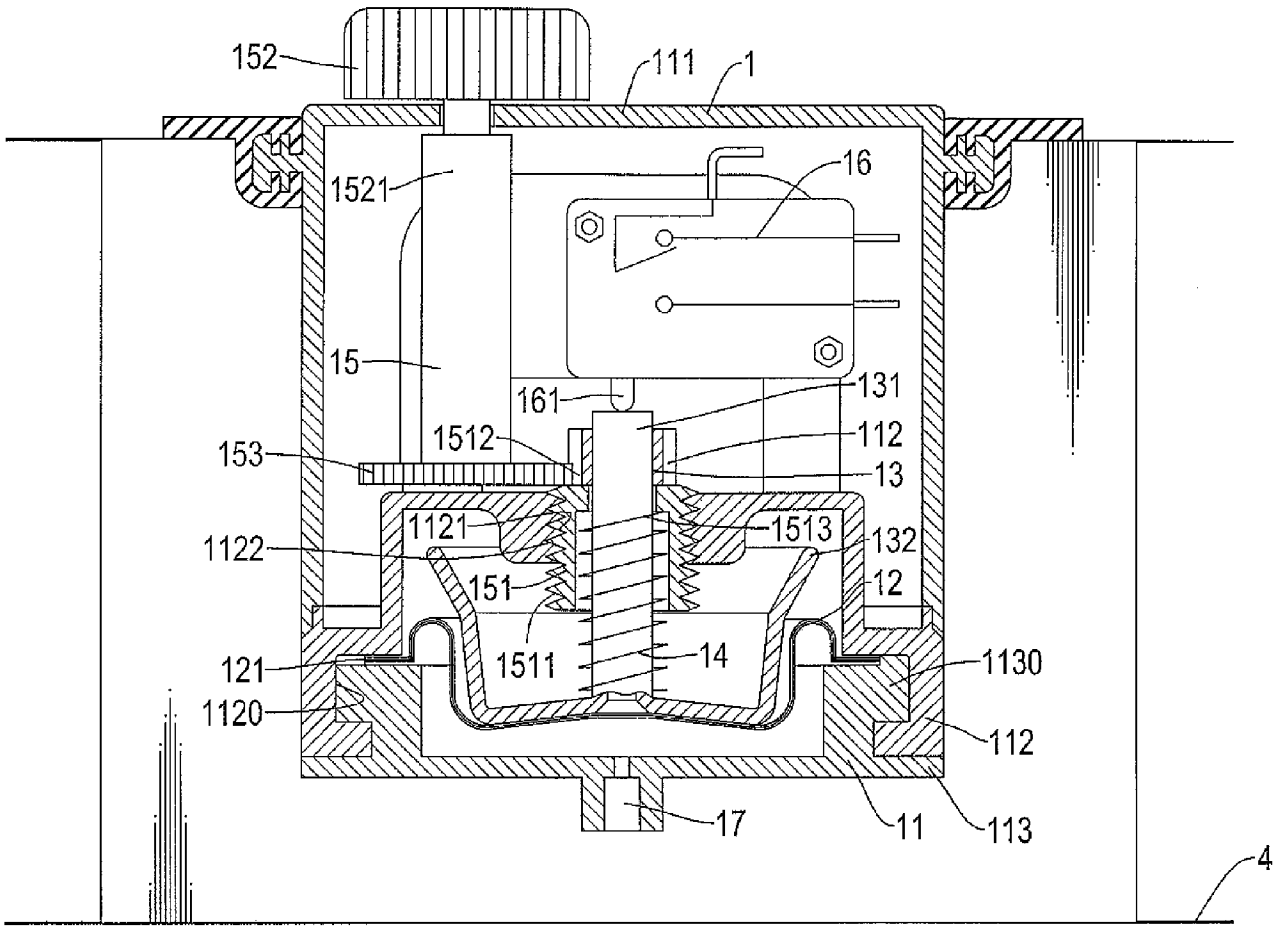
FIG. 1 is a schematic cross sectional view showing the structure of the present invention.

With reference to FIG. 1, it is noted that the pressure switch (1) in accordance with the present invention includes a casing (11), a resilient element (12), a driving element (13), a spring (14), a load adjusting assembly (15) and an electrical on/off switch (16).

The casing (11) is composed of a U-shaped top casing (111), an inverse U-shaped mediate casing (112) and a U-shaped bottom casing (113) interrelated to the mediate casing (112) in such a manner that a space is defined therebetween. The mediate casing (112) is provided with a recess (1120) defined in an inner periphery of the mediate casing (112) and a centrally defined through hole (1121) defined through a top face of the mediate casing (112) and having a first threading (1122) defined in an inner periphery defining the through hole (1121). To correspond to the recess (1120) of the mediate casing (112), the bottom casing (113) is provided with a step (1130) to be received in the recess (1120) and an airway (17) defined through a bottom face of the bottom casing (113) so as to allow a space confined by the bottom casing (113) and the mediate casing (112) to communicate with air inside the inflatable body after the pressure switch of the present invention is positioned inside the inflatable body.

The resilient element (12) is substantially U shaped and has two ends (121) respectively supported by the step (1130) of the bottom casing (113) and engaged with a top inner face defining the recess (1120) of the mediate casing (112). The driving element (13) has a bowl like bottom (132) and a central rod (131) extending from a bottom face of the bowl like bottom (132) and out of the through hole (1121) of the mediate casing (112). The bowl like bottom (132) is part of the resilient element (12) and the spring (14) is positioned around the central rod (131). The load adjusting assembly (15) includes a sliding block (151) inserted into the through hole (1121) of the mediate casing (112) and positioned around the central rod (131). The sliding block (151) has a second threading (1511) formed on an outer periphery thereof to correspond to and mate with the first threading (1122) of the mediate casing (112) and a shoulder (1513) to abut a distal end of the spring (14), wherein the proximal end of the spring (14) is abutted against a bottom face of the mediate casing (112). A knob (152) is rotatably positioned on top of the top casing (111) and has a rod (1521) integrally extending from the knob (152) and a gear (153) formed on a distal free end of the rod (1521) to correspond to beveled teeth (1512) formed on an outer periphery of the sliding block (151) to be adjacent to the second threading (1511). The switch (16) is an ordinary on/off switch and has a pushbutton (161) formed on a bottom of the switch (16) to correspond to and engage with a top face of the central rod (131).

When the pressure switch of the present invention is employed in an inflatable body (4), the top casing (111) is integrally formed with a periphery of the inflatable body (4) such that the resilient element (12) is affected by pressure inside the inflatable body (4) via the airway (17). When the pressure inside the inflatable body (4) is larger than a recovery force of the spring (14), the driving element (13) is pushed by the resilient element (12), which results in that the central rod (131) of the driving element (13) is moved to engage with the pushbutton (161) of the switch (16) to turn off the switch (16). After the switch (16) is off, a pump responsible for inflation of the inflatable body (4) stops operation and the pressure inside the inflatable body (4) is maintained.

However, when the pressure inside the inflatable body (4) is decreased, the recovery force of the spring (14) overcomes the pressure inside the inflatable body (4) so that the central rod (131) is moved away from the pushbutton (161), which activates the operation of the pump to inflate the inflatable body (4). Further, rotation of the knob (152) is able to drive the central rod (131) to move upward or downward relative to the casing due to the engagement between the gear (153) and the beveled teeth (1512). When the central rod (131) is moved upward, the load on the spring (14) is lessened and the pressure required to push the driving element (13) to move is reduced. However, when the central rod (131) is moved downward, the load on the spring (14) is increased and thus the pressure required to push the driving element (13) to move is also increased.

Figure 2:
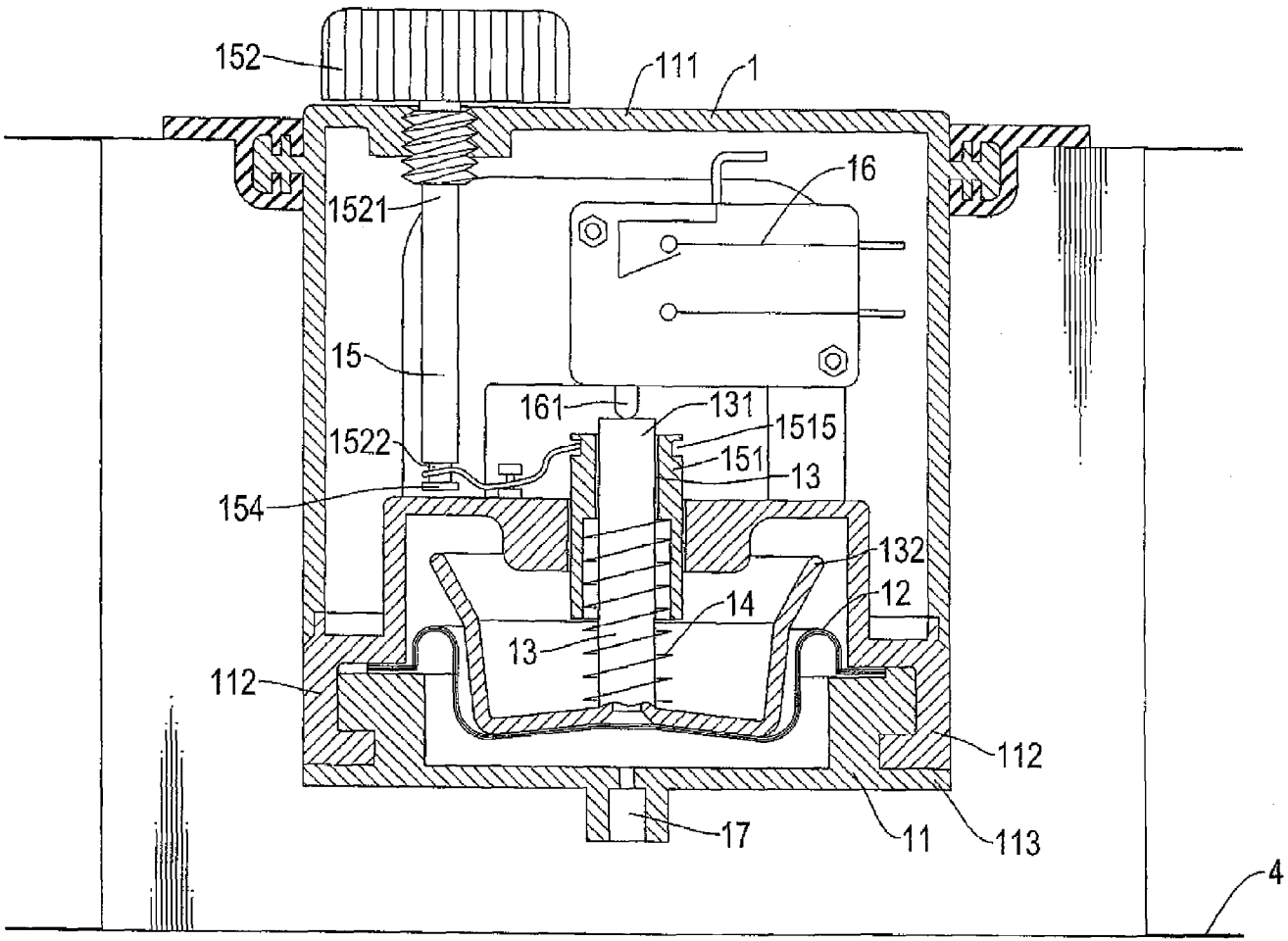
FIG. 2 is a schematic cross sectional view showing that the load adjusting assembly is modified and a leverage is employed.

With reference to FIG. 2, the pressure switch of the present invention is configured substantially the same as that shown in FIG. 1. The only difference therebetween is that the load adjusting assembly (15) is now provided with a sliding block (151) having the same structure as that in the first embodiment, a knob (152) threadingly and rotatably positioned on the top casing (111) and having a rod (1521) extending downward from the knob (152) and a leverage (154) having a first end loosely positioned around a neck (1522) formed on a distal free end of the rod (1521) and a second end securely connected to an outer periphery of the sliding block (151). In this embodiment, the sliding block (151) is provided with a indent (1515) defined in the outer periphery of the sliding block (151). A mediate portion of the leverage (154) is positioned on a top face of the mediate casing (112). Therefore, rotation of the knob (152) is able to adjust load on the spring (14). That is, when the knob (152) is moved upward, the central rod (131) as well as the bowl like bottom (132) is depressed and the load on the spring (14) is increased. When the knob (152) is moved closer to the top casing (111), which substantially lifts the central rod (131) as well as the bowl like bottom (132), the load on the spring (14) is lessened.

Figure 3A:
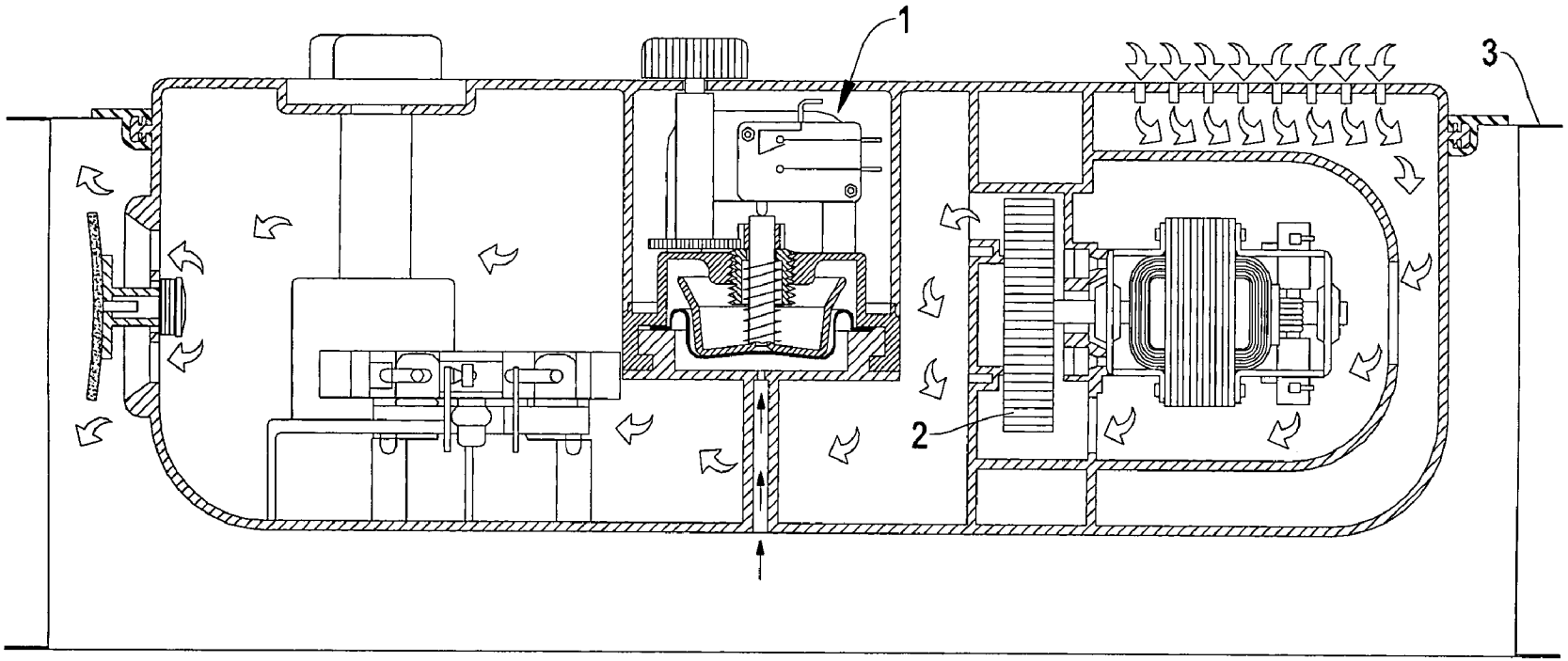
FIG. 3A is a cross sectional view showing that the pressure switch of the present invention as well as a pump is assembled inside the inflatable body.
Figure 3B:
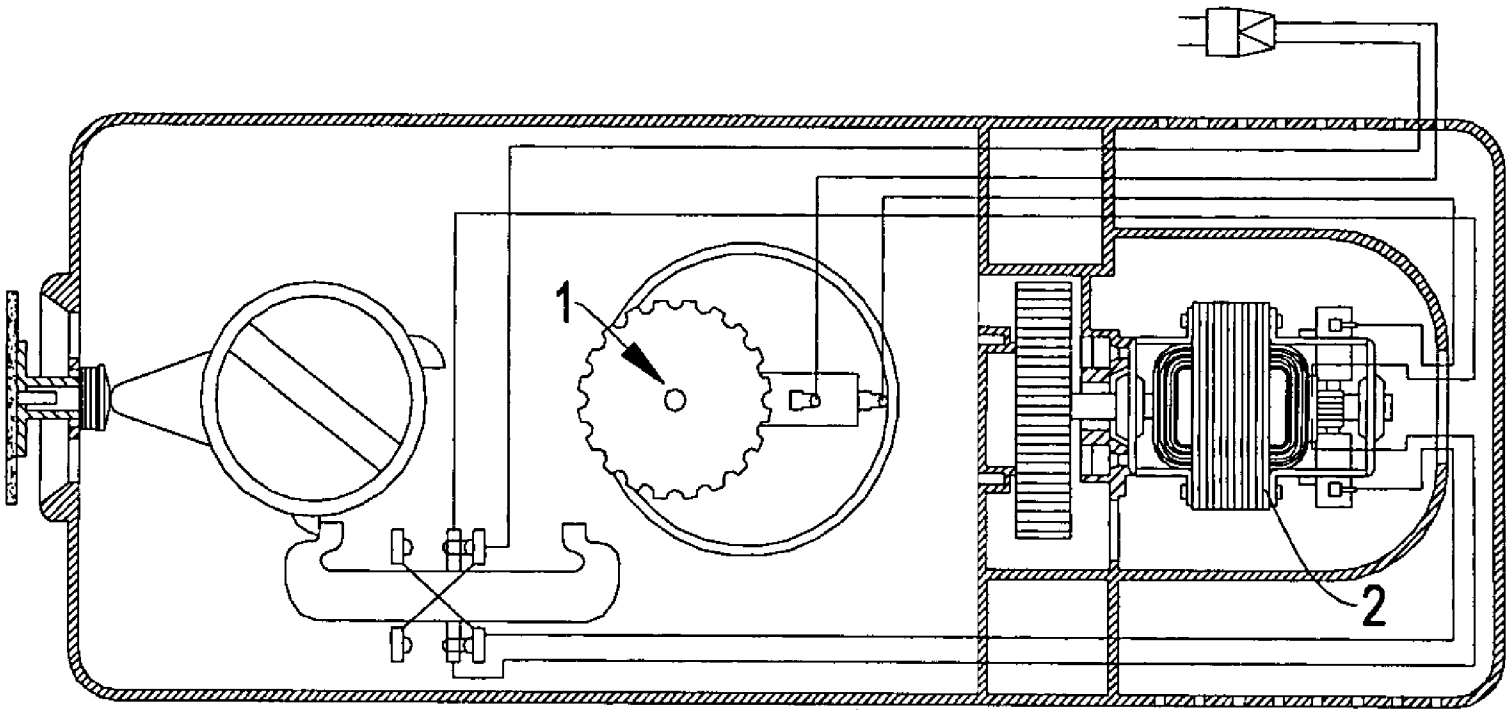
FIG. 3B is a schematic top cross sectional view of FIG. 3A.

With reference to FIGS. 3A and 3B, the pressure switch (1) of the present invention is installed inside an air pump (2), which all together are installed inside the inflatable body (3). The electrical connector (not numbered) of the air pump is connected to the switch (16) so that it is noted that the air pump (2) operation is totally controlled by the activation/deactivation of the pressure switch (1) of the present invention.

Figure 4A:
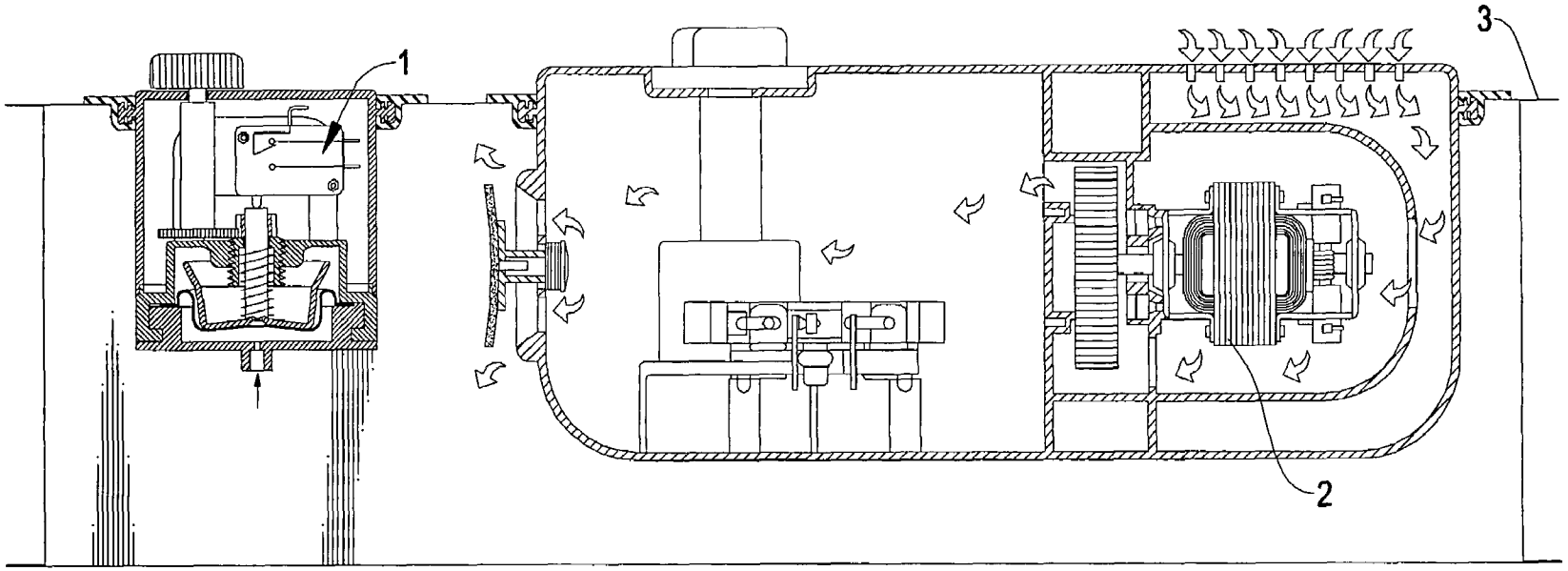
FIG. 4A is a cross sectional view showing the arrangement of the pressure switch of the present invention and the pump inside the inflatable body, which is not the same as that shown in FIG. 3A.
Figure 4B:
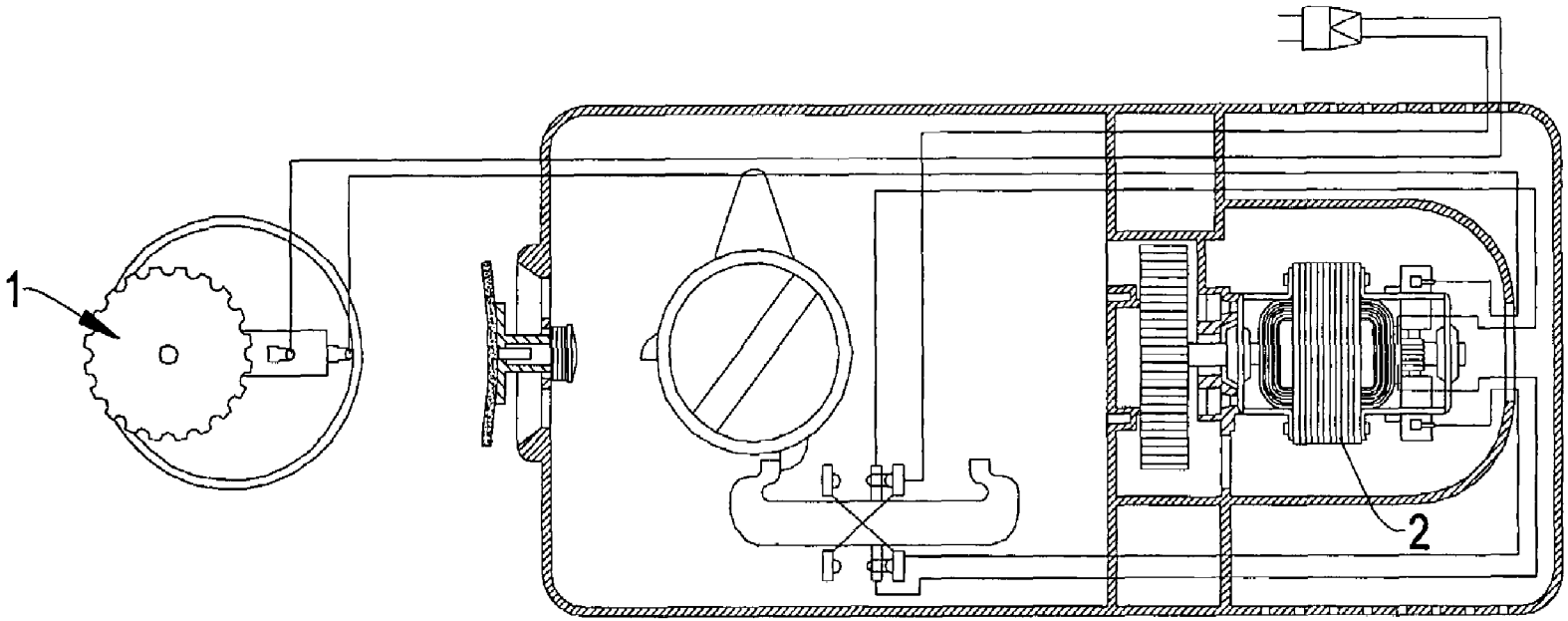
FIG. 4B is a schematic top cross sectional view of FIG. 4A.

With reference to FIGS. 4A and 4B, it is seen that the air pump (2) and the pressure switch (1) of the present invention are respectively installed inside the inflatable body (3). The electrical connector of the air pump (2) is connected to the switch (16) of the pressure switch (1) such that when the switch (16) is initiated, the air pump (2) is activated and when the switch (16) is deactivated, the air pump (2) operation is thus stopped.

Figure 5:
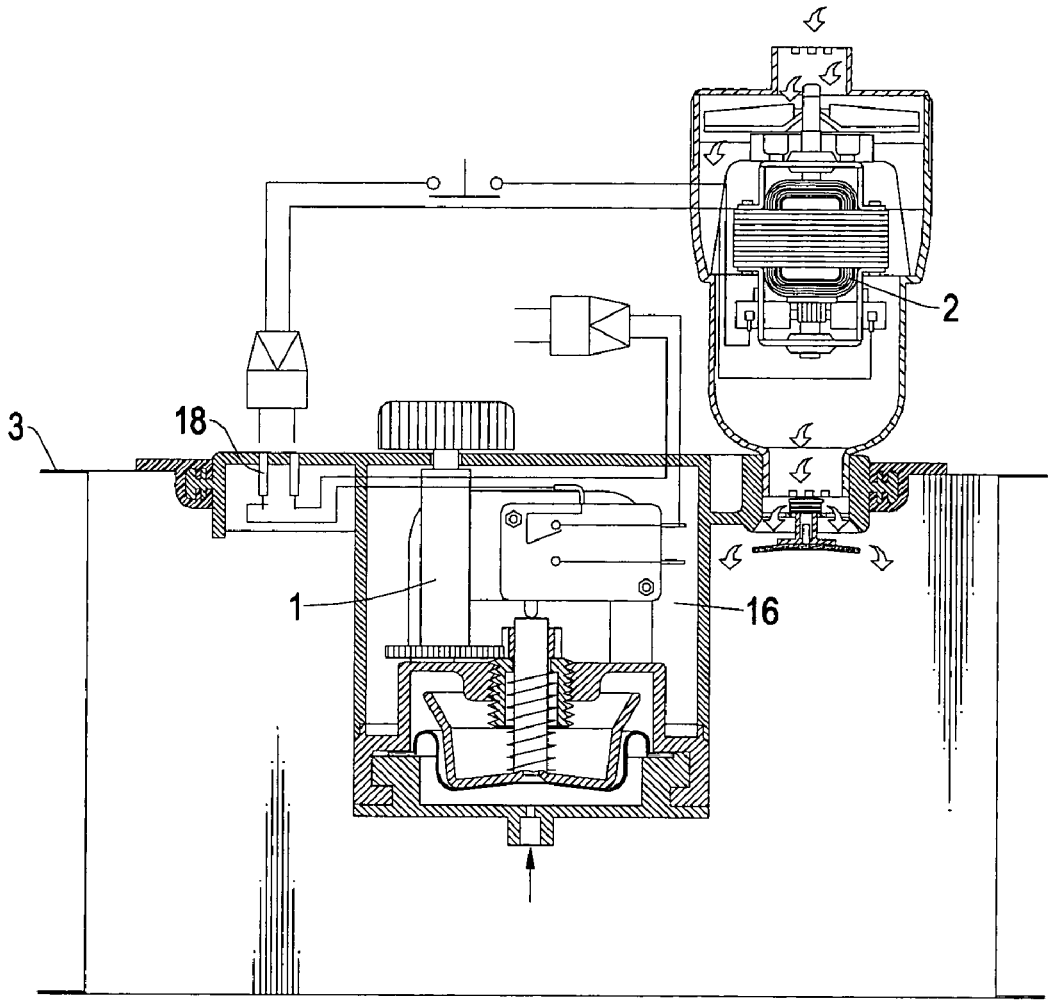
FIG. 5 is a schematic cross sectional view showing that the pressure switch is installed inside the inflatable body and a plug extending from the pump is connected to and controlled by the switch of the pressure switch of the present invention.

With reference to FIG. 5, the pressure switch (1) of the present invention in connection with a power source is installed inside the inflatable body (3) and provided with an electrical connector (18) in connection with the switch (16) so as to provide electricity to the air pump (2) outside the inflatable body (3).

Figure 6:
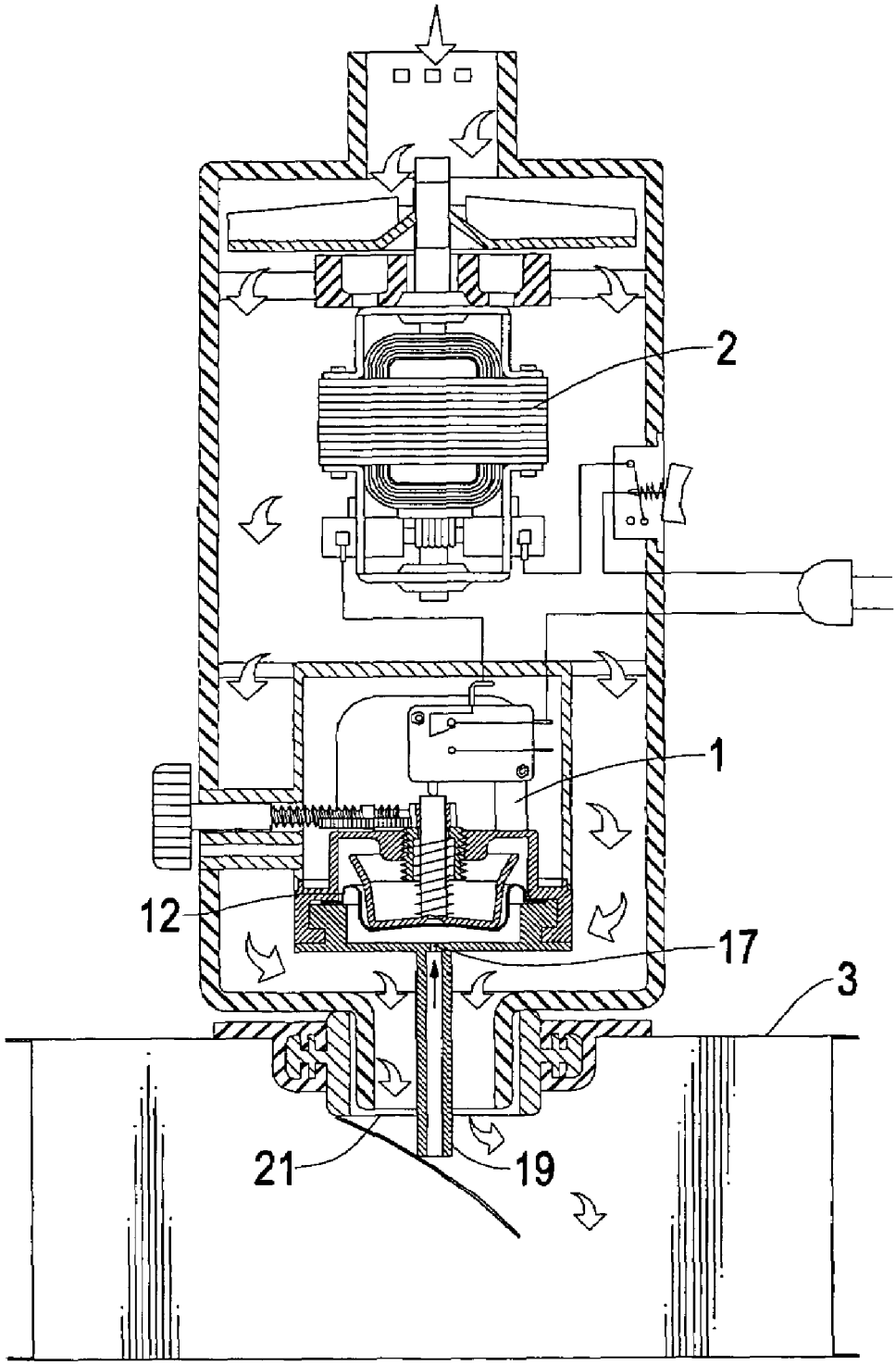
FIG. 6 is a schematic cross sectional view showing that the pressure switch of the present invention is integrated with the pump.

With reference to FIG. 6, the pressure switch (1) of the present invention is installed inside the air pump (2) and the switch (16) of the pressure switch (1) is connected to the electrical connector of the air pump (2). Furthermore, the pressure switch (1) has a tube (19) extending from the airway (17) to an outlet (21) of the air pump (2) such that when the air pump (2) is inflating the inflatable body (3) with the outlet (21) extended into the inflatable body (3), the pressure inside the inflatable body (3) may still be sensed by the resilient element (12) via the tube (19).

Figure 7A:
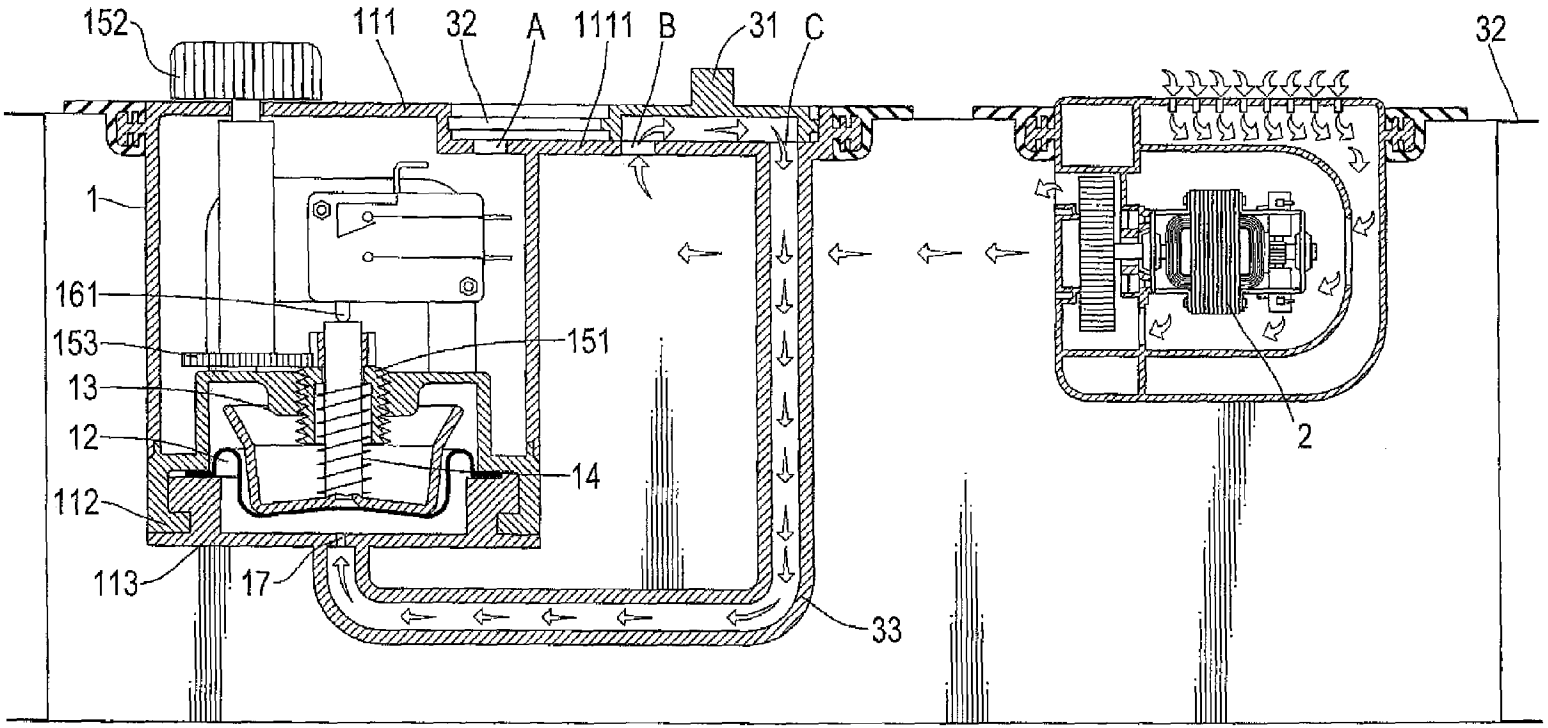
FIG. 7A is a schematic cross sectional view showing that the casing of the present invention is provided with an exchanging chamber, wherein the sliding block is moved to allow inflation to the inflatable body.
Figure 7B:
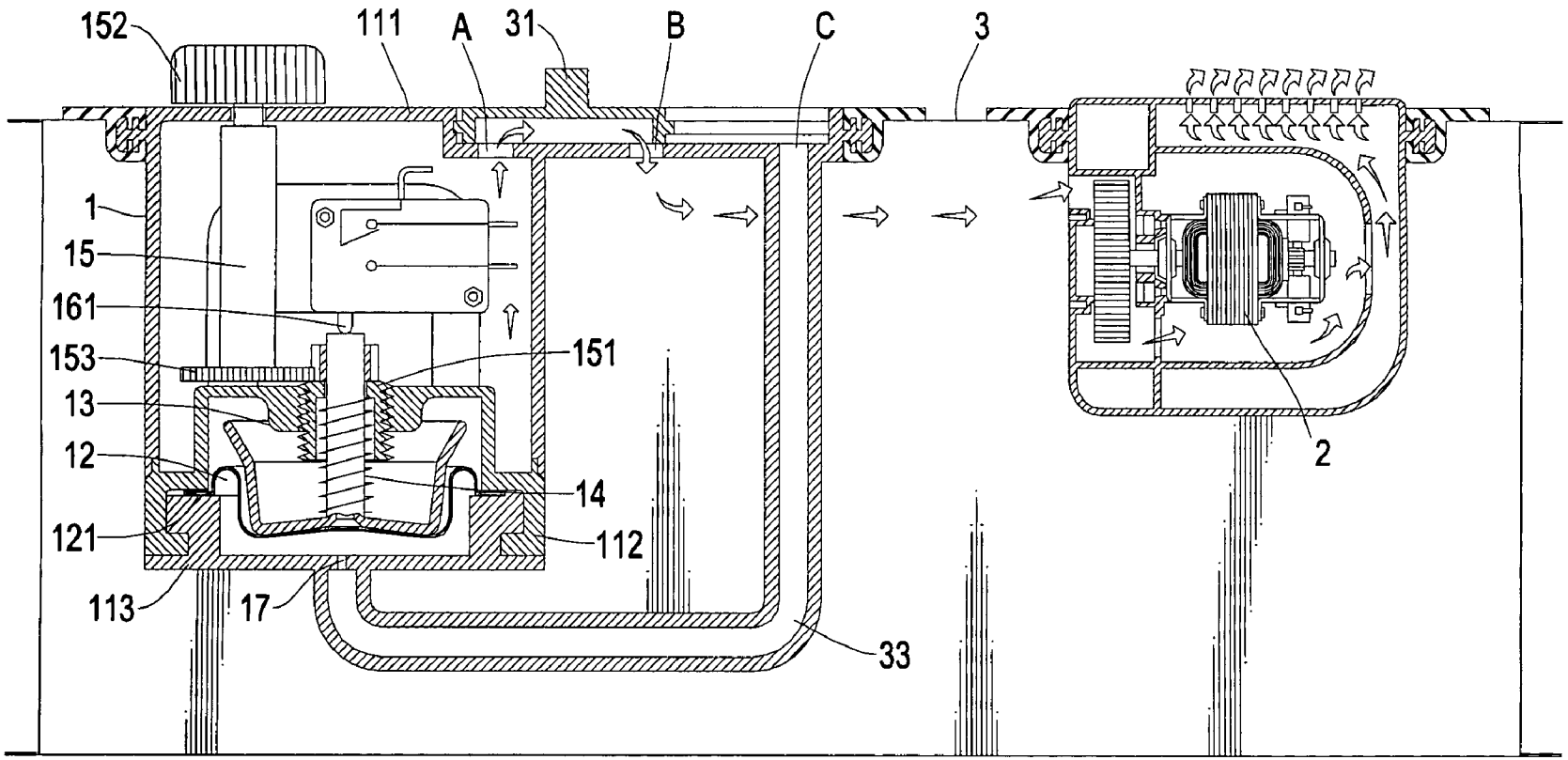
FIG. 7B is a schematic cross sectional view showing that the sliding block is moved to allow deflation to the inflatable body.
Figure 7C:
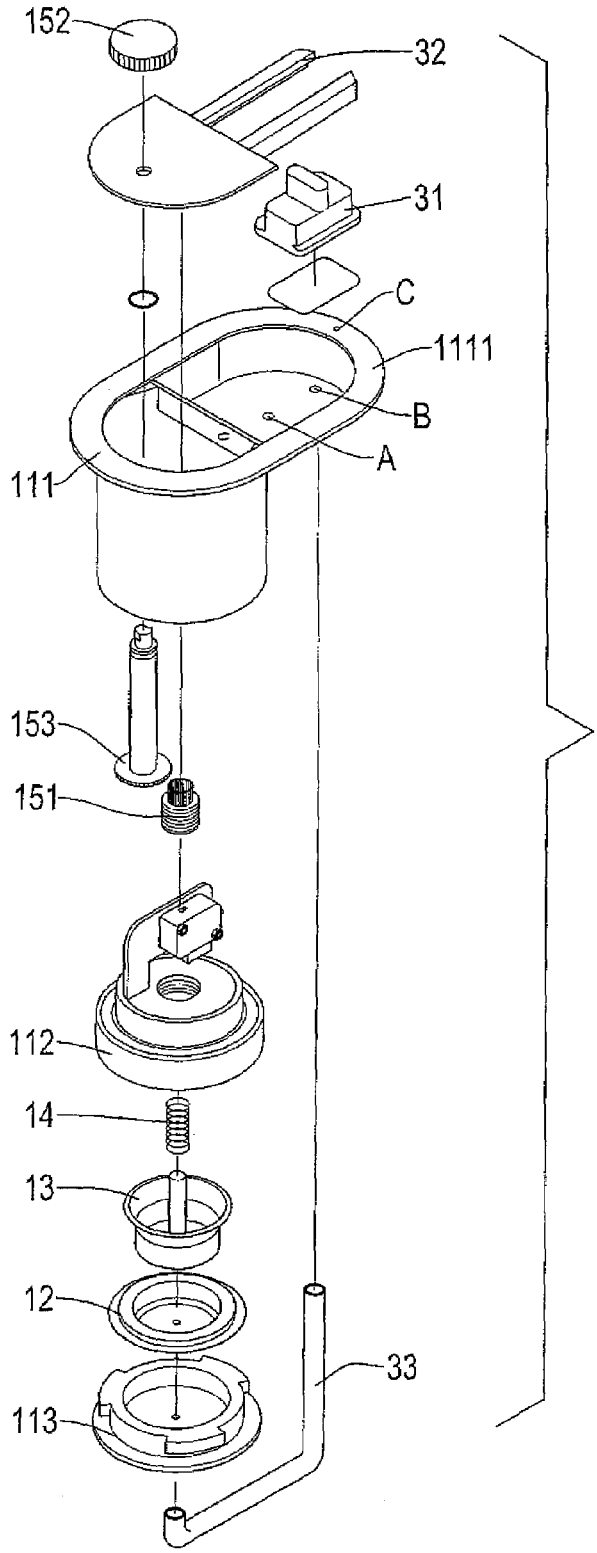
FIG. 7C is an exploded perspective view showing parts of the embodiment shown in FIG. 7A.
Figure 8A:
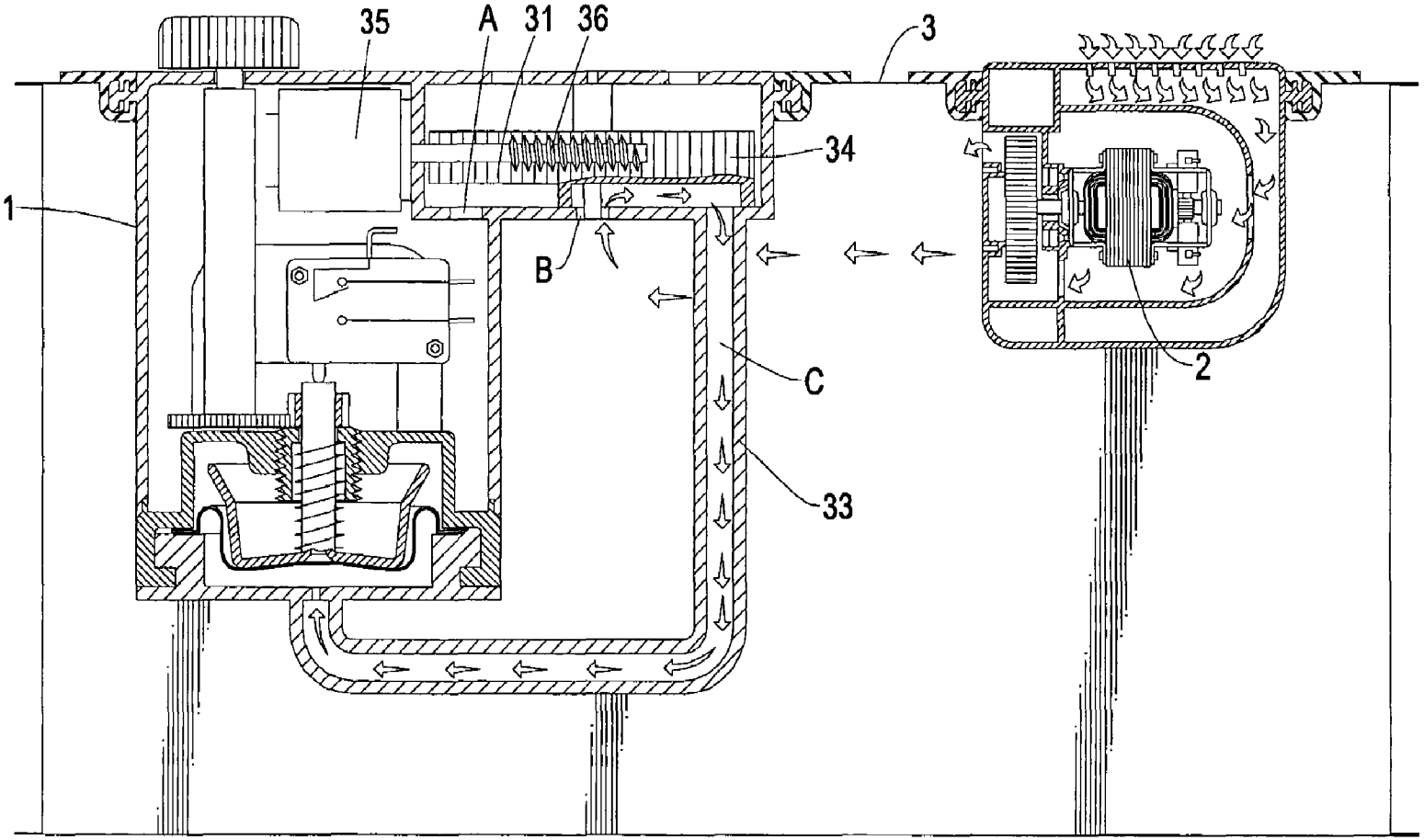
FIG. 8A is a cross sectional view showing a different exchanging chamber from that shown in FIG. 7A, wherein the inflatable body is inflating.
Figure 8B:
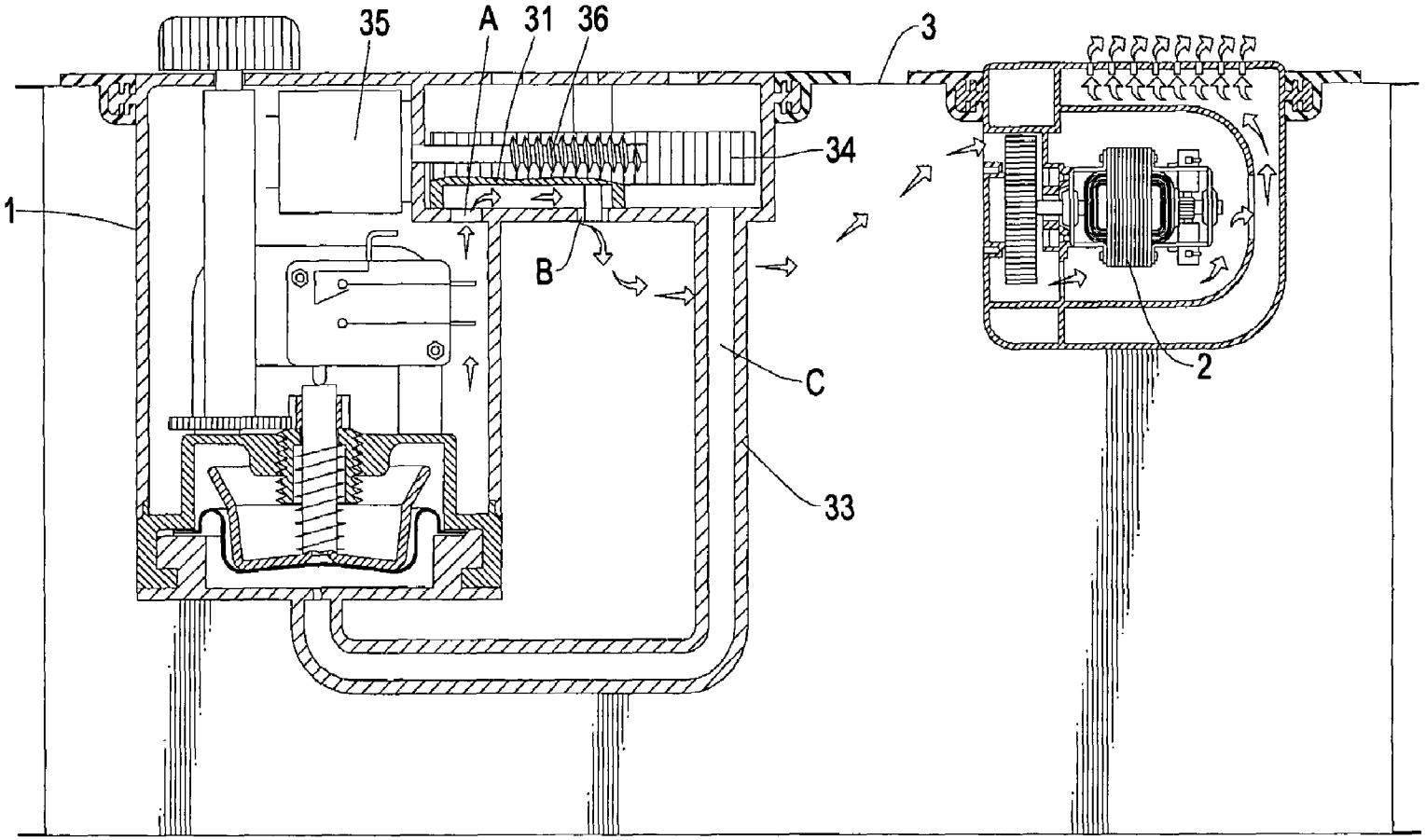
FIG. 8B is an operational view showing that the inflatable body is deflating.
Figure 8C:
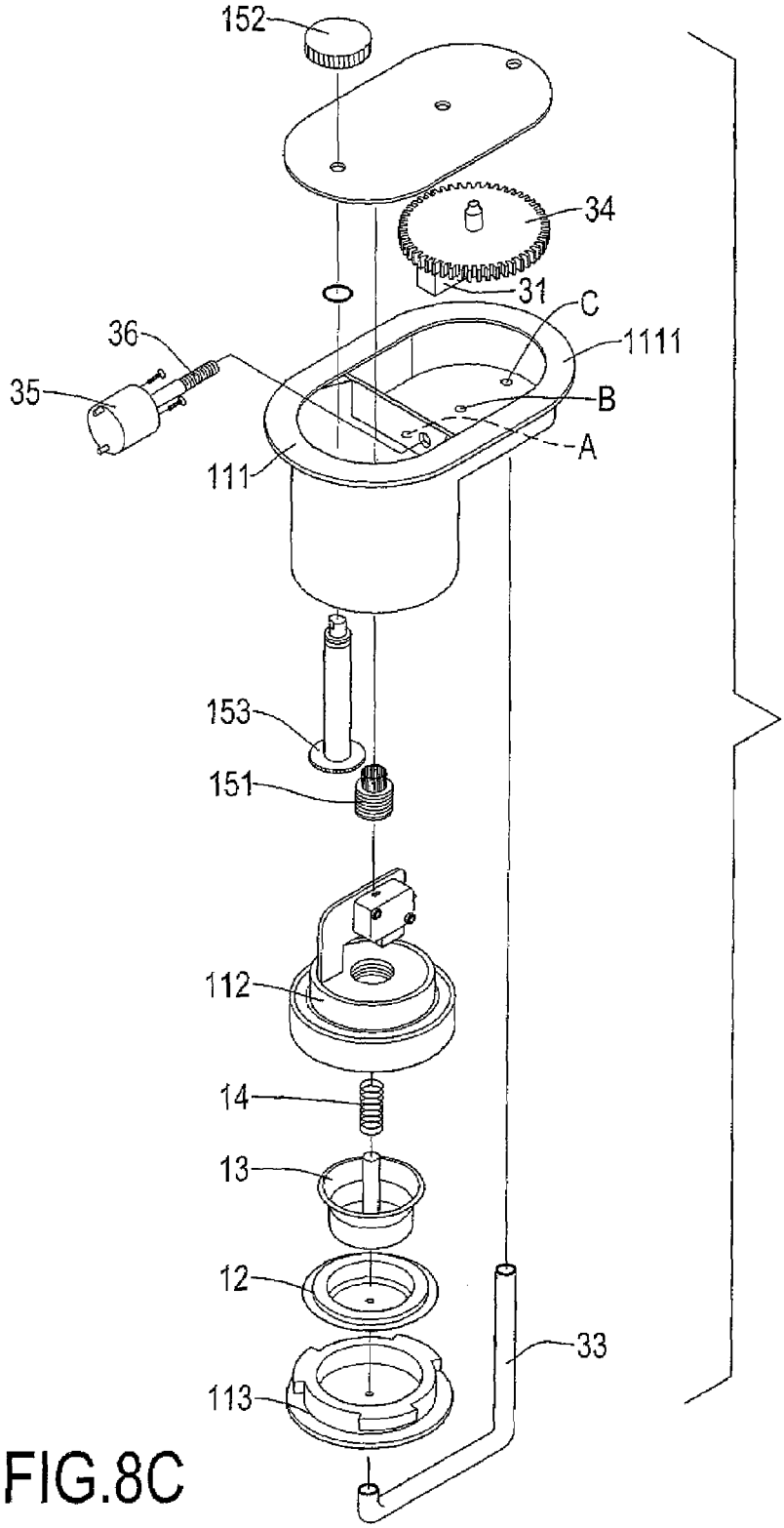
FIG. 8C is an exploded perspective view of the parts shown in FIG. 8A.
Figure 8D:
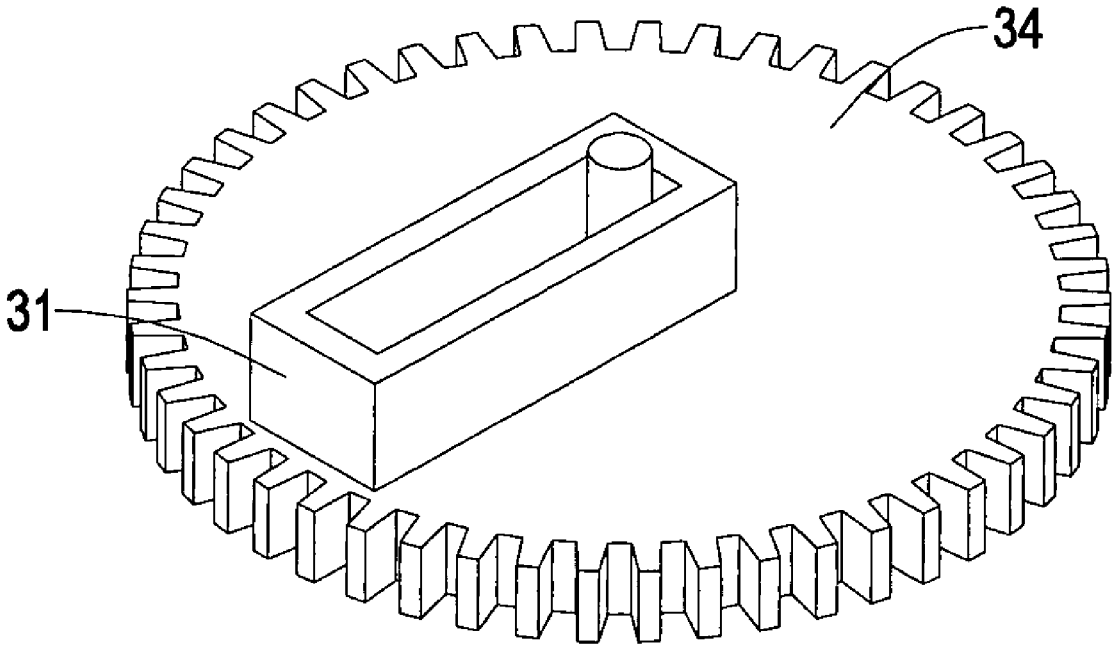
FIG. 8D is a perspective view showing the gear employed in this embodiment.

With reference to FIGS. 7A, 7B and 7C, the pressure switch in this embodiment is substantially the same as that shown in FIG. 1. The only difference therebetween is that the top casing (111) is provided with an exchanging chamber (1111) having three holes (A,B,C). The hole (A) is provided to communicate the exchanging chamber (1111) with the interior of the top casing (111). The hole (B) is provided to communicate the exchanging chamber (1111) with an interior of the inflatable body (3). An air tube (33) is extending from the hole (C) to communicate with the airway (17). The top casing (111) is provided with at least one track (32) formed therein and a sliding block (31) is movably received inside the exchanging chamber (1111) with the confinement of the track (32) such that the sliding block (31) is able to alternately block the hole (A) and the hole (C). That is, when the sliding block (31) is moved to the right (seen in FIG. 7A)*to* communicate hole (B) with hole (C) via the exchanging chamber (1111), the pressure switch is ready for inflation. When the sliding block (31) is moved to the left (seen in FIG. 7B) to communicate hole (B) with hole (A), the pressure switch is ready for deflation. That is, the air inside the inflatable body is able to escape from hole (A) and hole (B) to be away from the inflatable body. When the pressure switch of the present invention is ready for inflation, the pressure inside the inflatable body (3) may still be sensed by the resilient element (12) via hole (B), hole (C), tube (33) and the airway (17). When the pressure switch of the present invention is ready for deflation, i.e. the sliding block (31) is moved to the left in the exchanging chamber (1111), the pressure inside the inflatable body (3) is sensed by the resilient element (12) via hole (B) and hole (A).

With reference to FIGS. 8A~8D, it is noted that a motor (35) is positioned inside the pressure switch (1) of the present invention and a worm shaft (36) is extending out of the motor (35) to mate with a gear (34) which is received inside the exchanging chamber (1111) and mated with the sliding block (31) so that rotation of the worm shaft (36) as a result of the operation of the motor (35) is able to drive the sliding block (31) to move inside the exchanging chamber (1111) to accomplish the desired goals as stated above.

Figure 9A:
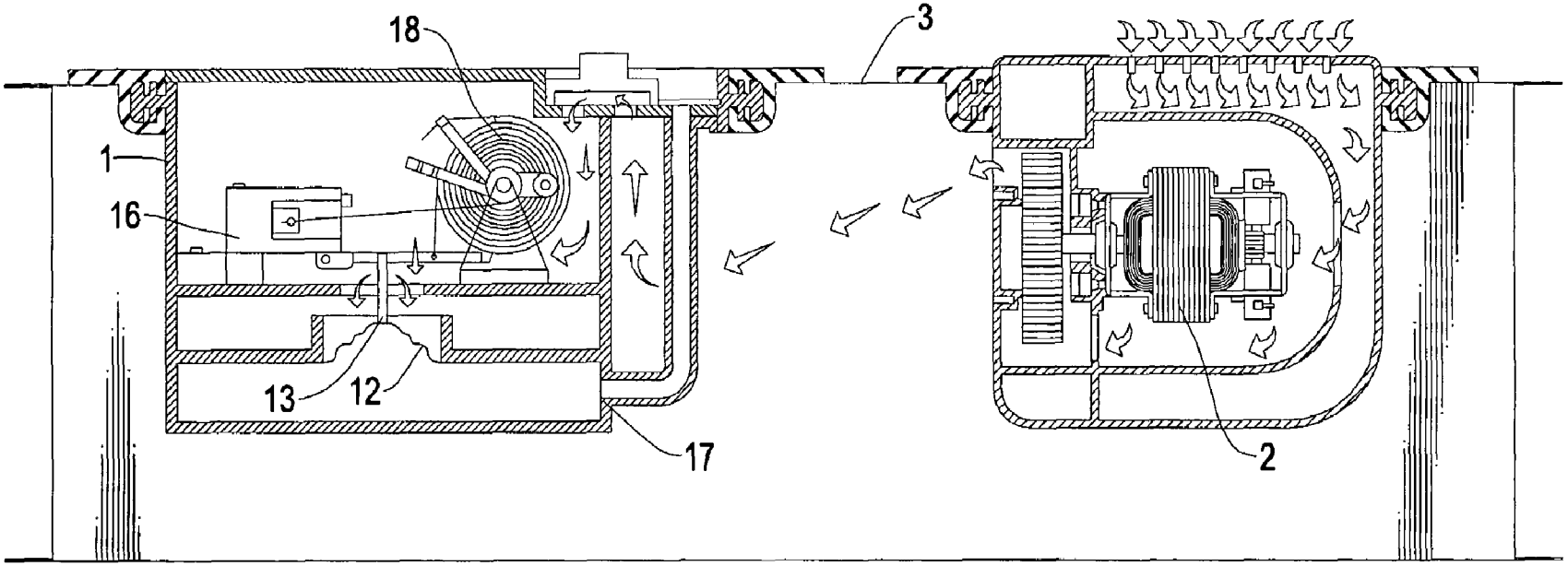
FIG. 9A is a schematic cross sectional view showing the application of the pressure switch with the exchanging chamber shown in FIG. 7A.
Figure 9B:
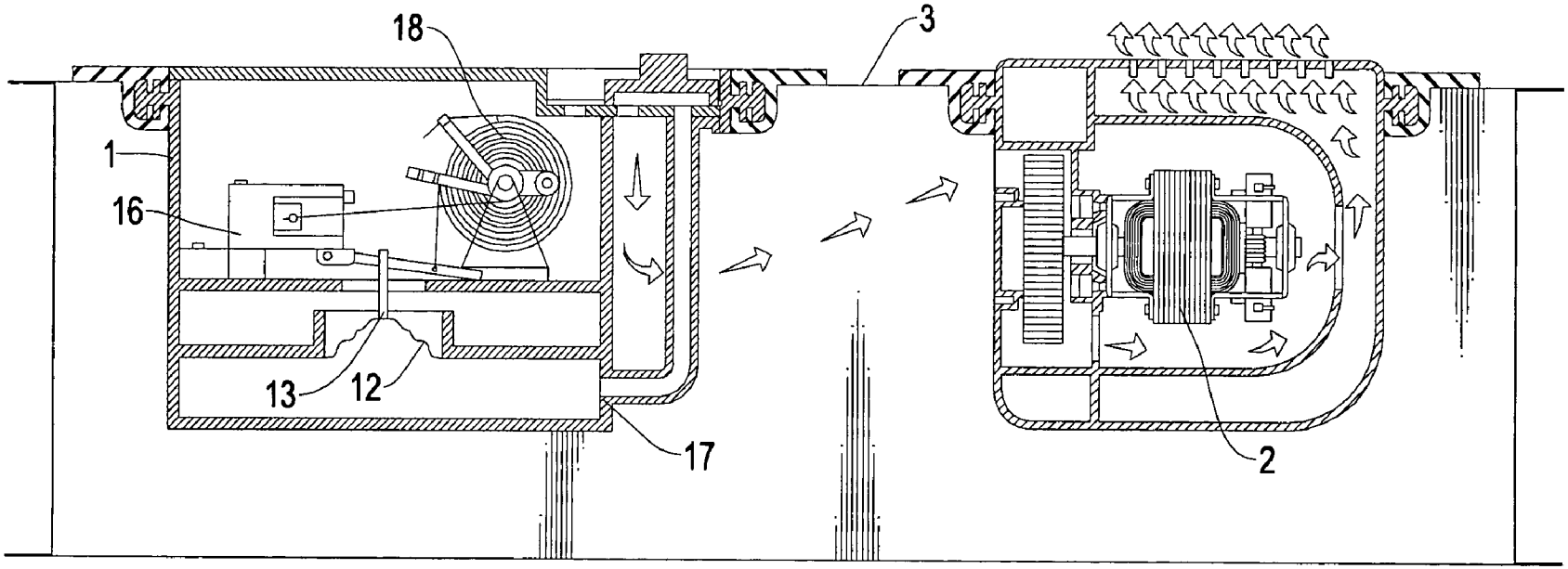
FIG. 9B is a schematic cross sectional view showing that the inflatable body is deflating via a different driving element of the present invention.
Figure 9C:
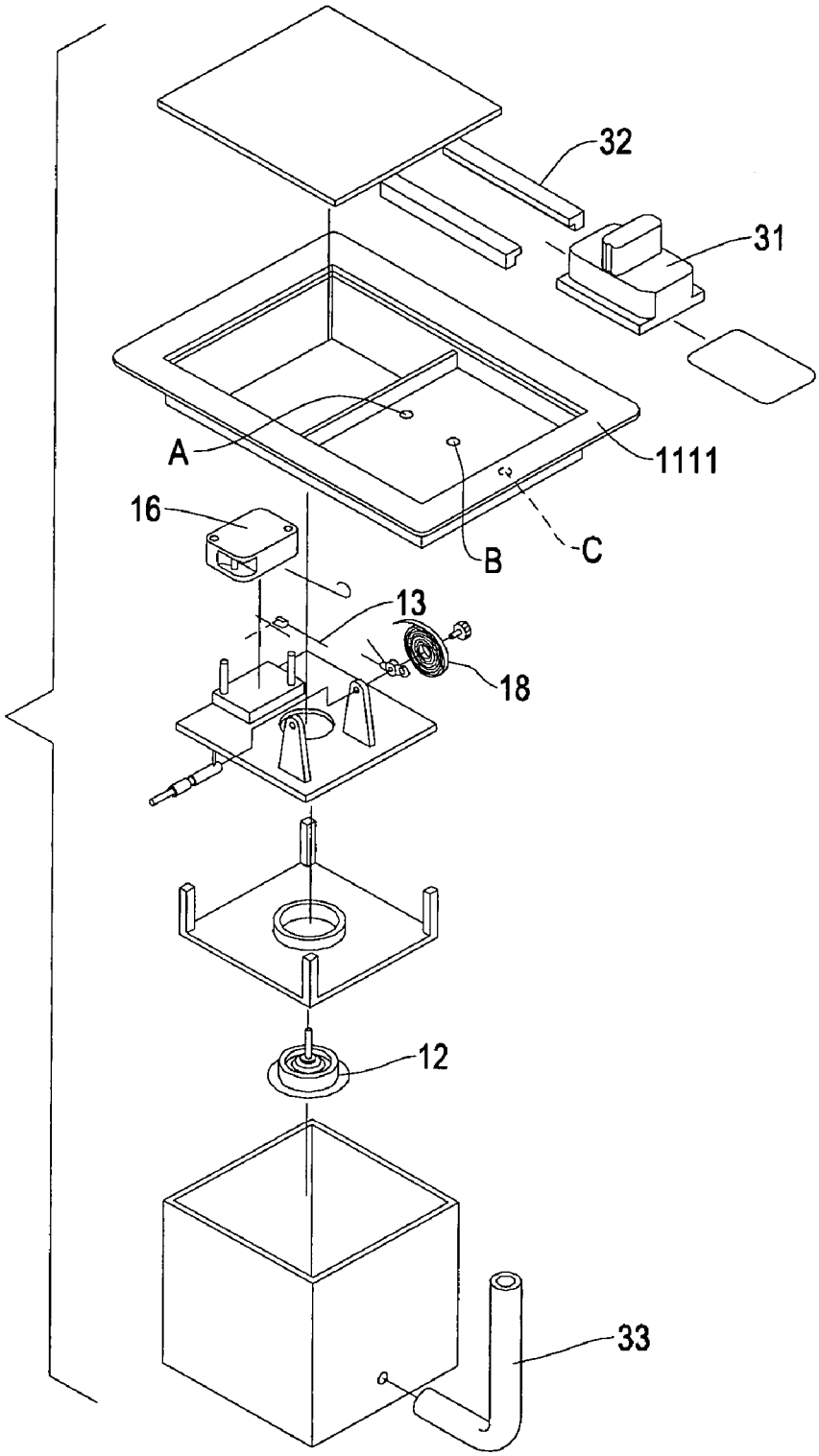
FIG. 9C is an exploded perspective view showing parts of the embodiment in FIG. 9A.
Figure 10A:
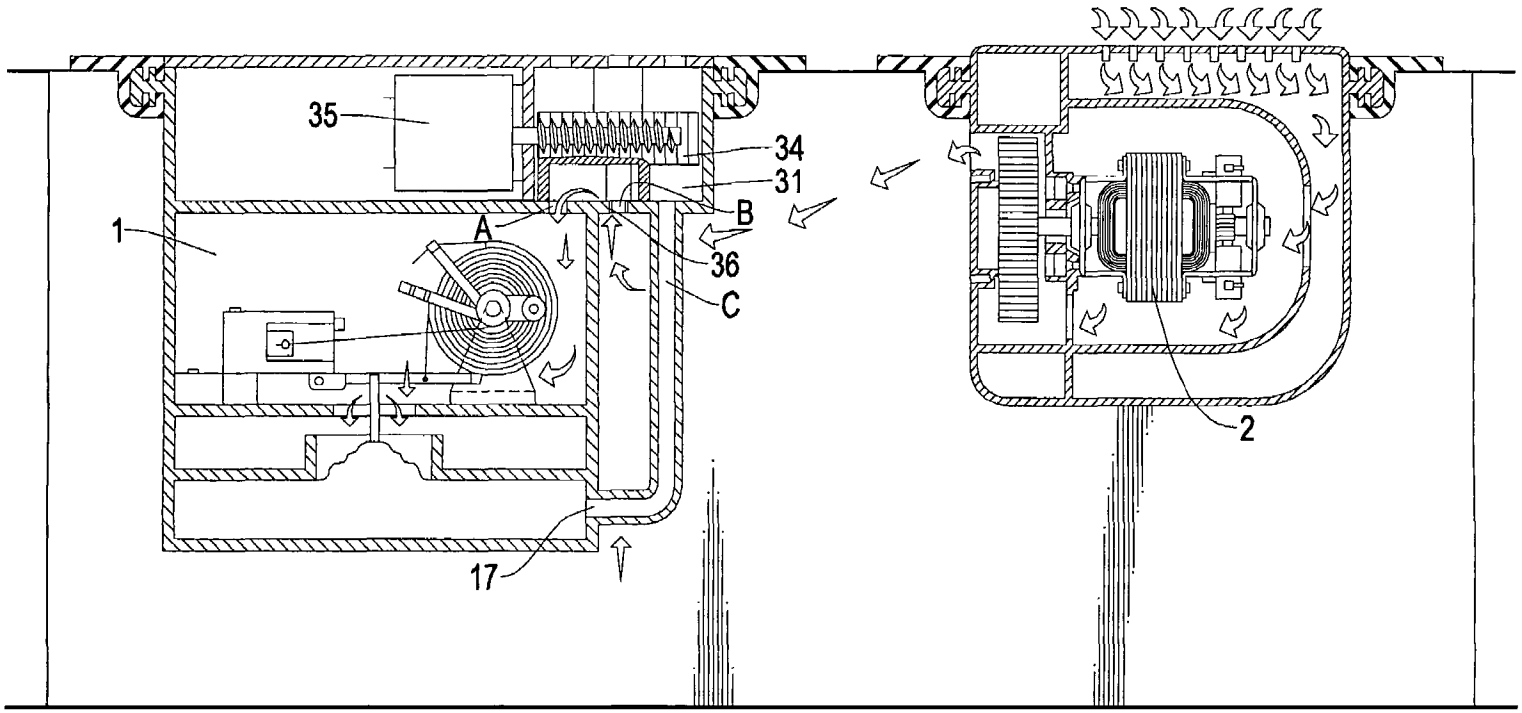
FIG. 10A is a schematic cross sectional view showing the inflation of the inflatable body, wherein the driving element is the same as that used in FIG. 8A.
Figure 10B:
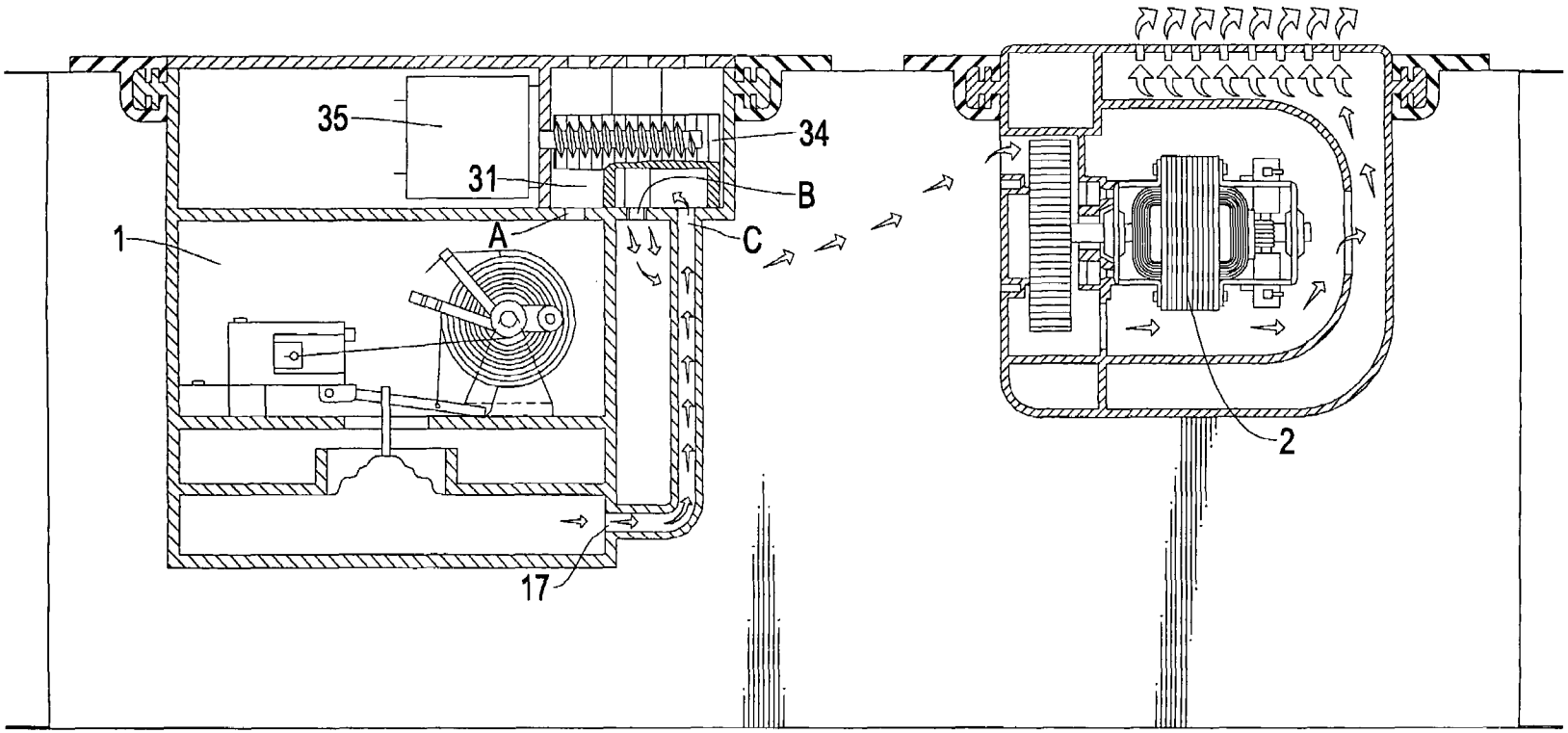
FIG. 10B is a schematic cross sectional view showing that the pressure switch is in deflating status.
Figure 10C:
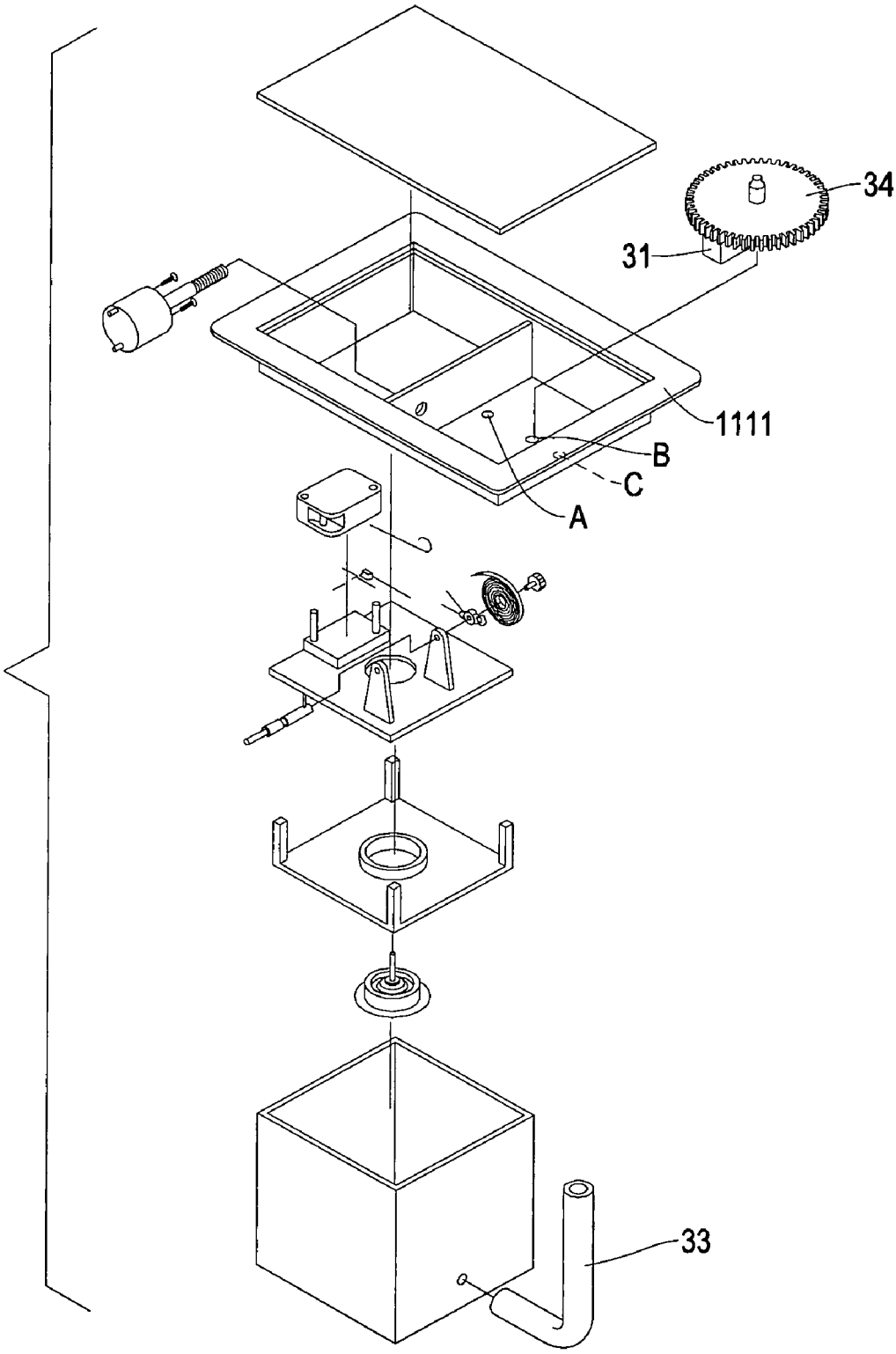
FIG. 10C is an exploded perspective view showing parts of the embodiment in FIG. 10A.
Figure 10D:
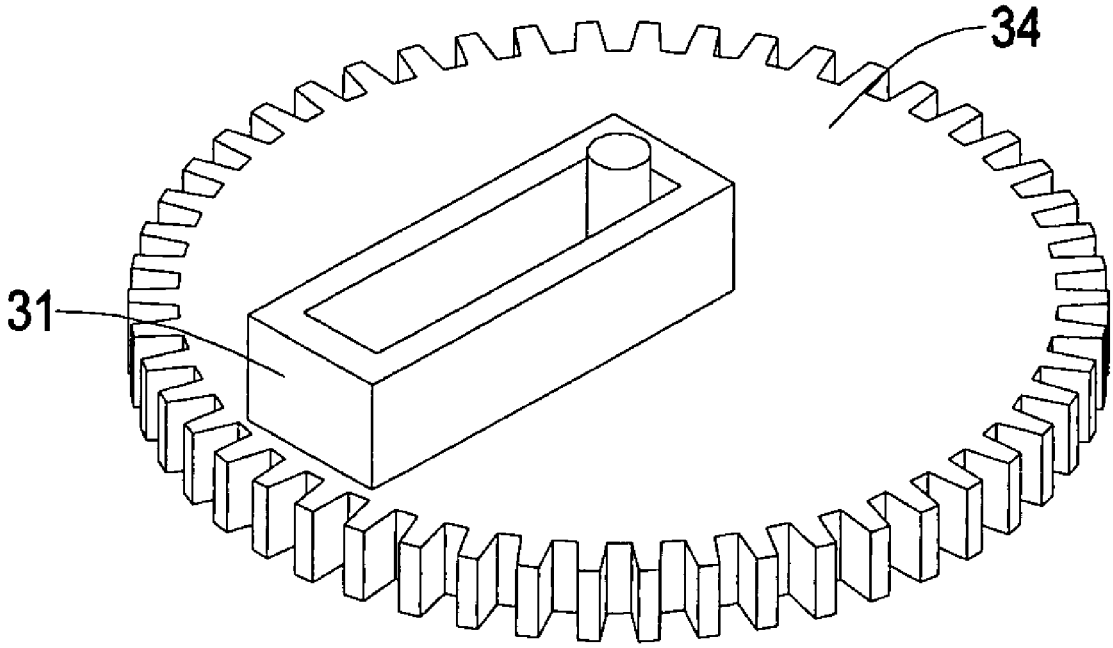
FIG. 10D is a perspective view showing the gear in FIG. 10C.

With reference to FIGS. 9A to 9C, the driving element (13) is now composed of two T shaped rods. A leaf spring (18) has a first end connected to one of the two rods of the driving element (13) and a second end connected to the on/off switch (16). The other rod of the driving element (13) is connected to the resilient element (12). When in operation, the air inside the inflatable body enters the pressure switch of the present invention via the airway (17) to force the resilient element (12) to move. As a result of the movement of the resilient element (12), the driving element (13) is moved. Therefore, when the pressure inside the inflatable body is larger than that of the recovery force of the leaf spring (18), the on/off switch (16) is stopped to stop inflation. However, when the pressure inside the inflatable body is less than that of the recovery force of the leaf spring (18), the on/off switch (16) is activated due to the influence of the leaf spring (18) to force the driving element (13) back to its original position. Thus the pump (2) is activated to increase the pressure inside the inflatable body. When in deflation, the sliding block (31) is moved to the right to communicate the interior of the pressure switch with the ambient air. Thus reverse operation of the air pump (2) draws air out of the inflatable body until a negative pressure inside the inflatable body is large enough to overcome the recovery force of the leaf spring (18) so as to turn off the on/off switch (16) to stop operation of the air pump (2).

With reference to FIGS. 10A to 10D, it is noted that the pressure switch (1) is substantially the same as that shown in the ninth embodiment shown in FIGS. 9A to 9C. Furthermore, the motor (35), the worm shaft (36) as well as the gear (34) are provided to drive the sliding block (31) to move, which has already been described in the embodiment shown in FIGS. 8A to 8D.

Figure 11A:
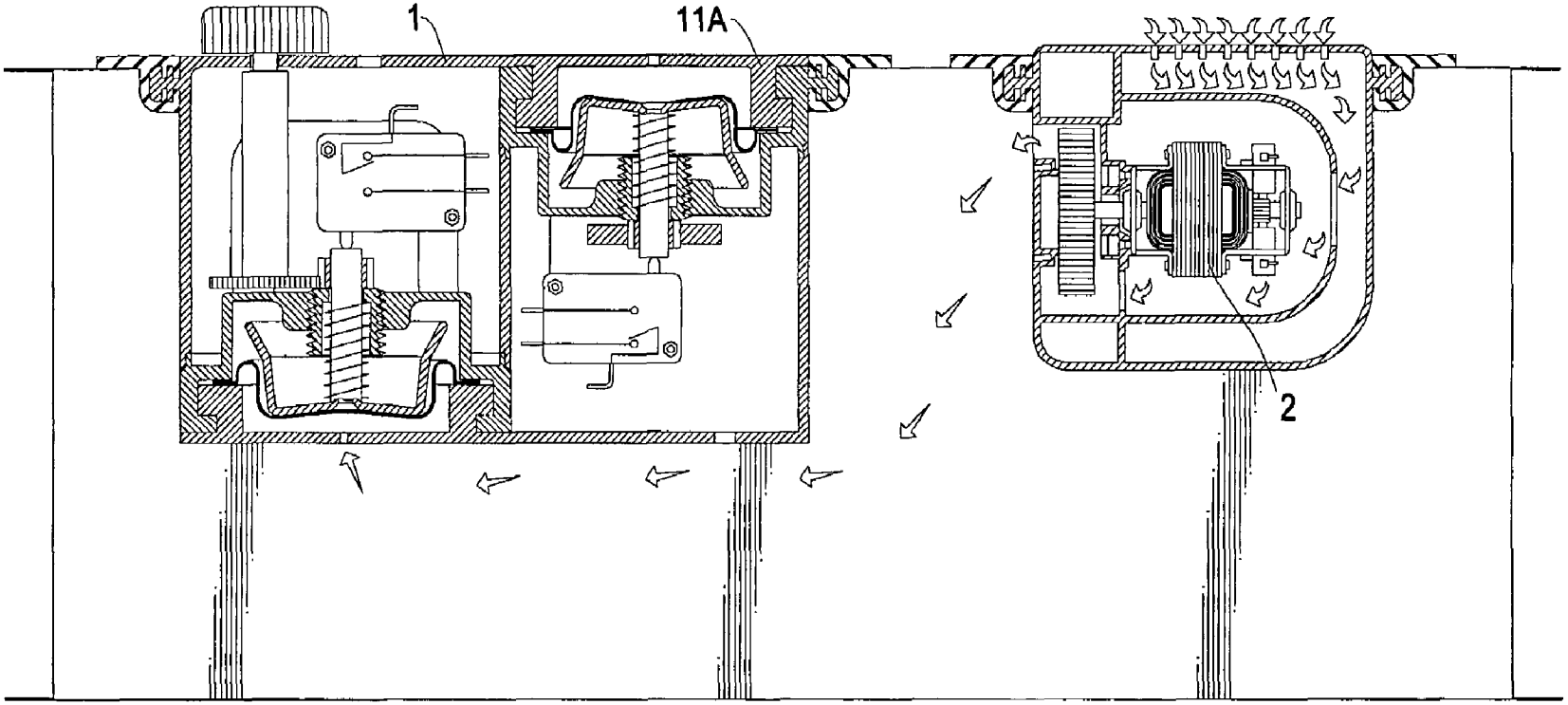
FIG. 11A is a schematic cross sectional view showing that the pressure switch of the present invention is in an inflation process.
Figure 11B:
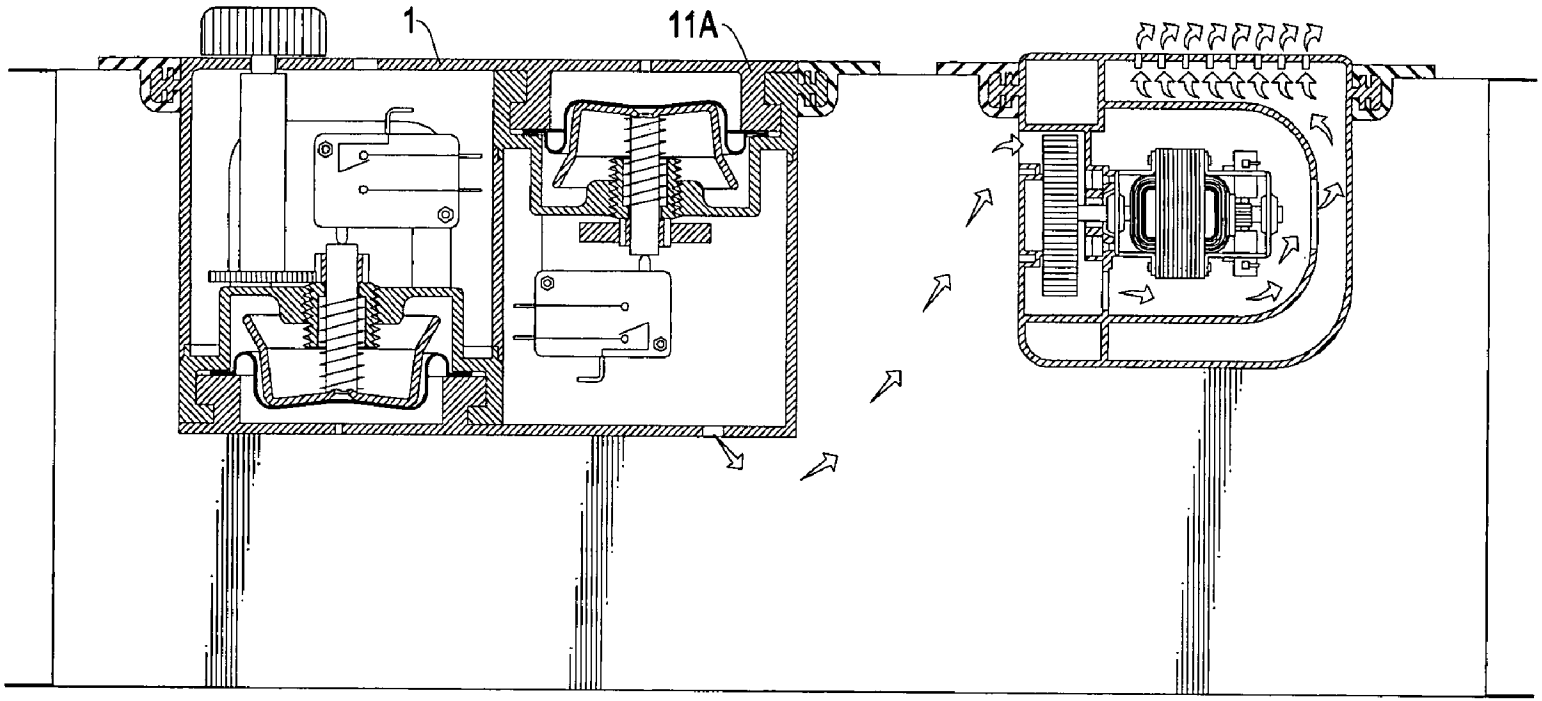
FIG. 11B is a schematic cross sectional view showing that the pressure switch of the present invention is in a deflation process.

With reference to FIGS. 11A and 11B, two pressure switches (1,11A) are provided to be responsible for inflating and deflating respectively. As operations thereof are substantially the same as those described in the previous embodiments, detailed description thereof is thus omitted.

Figure 12:
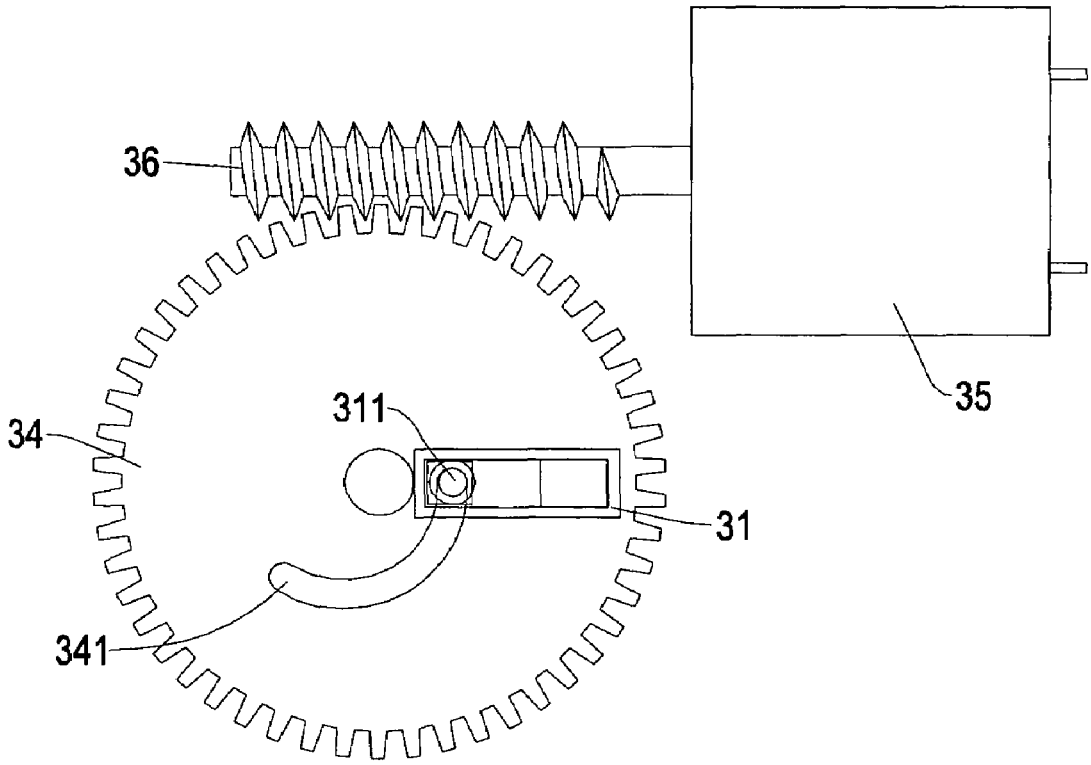
FIG. 12 is a schematic side plan view showing the embodiment of the present invention.

With reference to FIG. 12, the sliding block (31) is not connected to the gear (34). But the gear (34) is now provided with an arcuate recess (341) to receive therein a positioning rod (311) formed on the sliding block (31) such that when the gear (34) is rotated due to the driving of the motor (35), the sliding block (31) is moved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inflatable product comprising:

an inflatable body;

a pressure switch;

with the pressure switch comprising:

a casing with an airway adapted to communicate with an interior of the inflatable body;

a resilient element movably positioned inside the casing to define with the casing a space therebetween;

an on/off switch adapted to connect to an air pump;

a driving element movably positioned inside the casing to be in response to the movement of the resilient element so as to selectively activate or deactivate the on/off switch to activate or deactivate the air pump; and a recoil element positioned inside the casing so that a distal end of the recoil element is abutted against the resilient element, wherein the recoil element is compressed/decompressed when the resilient element moves in response to pressure change inside the inflatable body so that activation/deactivation of the on/off switch is controlled via the movement of the resilient element as well as the compression/decompression of the recoil element.

2. The inflatable product as claimed in claim 1, wherein the resilient element is made of a resilient material or a metal.

3. The inflatable product as claimed in claim 2 further comprising a load adjusting assembly connected to the driving element to adjust position of the driving element relative to the casing as well as the compression of the recoil element so that a force required to move the resilient element is changed in response to the position adjustment of the driving element.

4. The inflatable product as claimed in claim 1, wherein the driving element is a central rod extending inside the casing and the recoil element is positioned around the central rod.

5. The inflatable product as claimed in claim 4, wherein the on/off switch has a pushbutton extending downward thereof to selectively engage with the central rod to activate/deactivate the air pump.

6. The inflatable product as claimed in claim 5 further comprising a load adjusting assembly connected to the driving element to adjust position of the driving element relative to the casing as well as the compression of the recoil element so that a force required to move the resilient element is changed in response to the position adjustment of the driving element.

7. The inflatable product as claimed in claim 6, wherein the load adjusting assembly comprises a control means adjustably positioned on the casing and having a rod integrally extending from the control means, a gear positioned at a free end of the rod of the control means to mate with beveled teeth formed on an outer periphery of a sliding block which is adjustably connected to the casing and securely connected to the central rod so that adjustment of the control means is able to control position of the sliding block and the position of the central rod is changed.

8. The inflatable product as claimed in claim 7 further comprising a switching member connected to the casing to selectively communicate an interior of the switching member with an interior of the inflatable body to allow inflation or deflation to the inflatable body via a pump.

9. The inflatable product as claimed in claim 8, wherein the exchanging chamber has a first hole to communicate the exchanging chamber with the interior of the casing, a second hole to conm-iunicate the exchanging chamber with an interior of the inflatable body and a third hole, wherein an air tube extends from the third hole to communicate with the airway of the casing such that the s1iding block is able to alternately block the first hole to communicate the second hole with the third hole via the exchanging chamber for inflation/deflation.

10. The inflatable product as claimed in claim 9, wherein the sliding block is moved via a motor which is positioned inside the casing.

11. The inflatable product as claimed in claim 6, wherein the load adjusting assembly comprises a control means adjustably positioned on the casing and having a rod integrally extending downward from a knob a leverage having a first end loosely connected to a free end of the rod of the control means and a sliding block securely connected to the driving element, wherein a second end of the leverage is securely connected to the sliding block such that movement of the rod drives the sliding block as well as the driving element to move.

12. The inflatable product as claimed in claim 11 further comprising a switching member connected to the casing to selectively communicate an interior of the switching member with an interior of the inflatable body to allow inflation or deflation to the inflatable body via a pump.

13. The inflatable product as claimed in claim 12 further comprising an exchanging chamber connected to the casing and having a sliding block movably received inside the exchanging chamber to selectively communicate an interior of the exchanging chamber with an interior of the inflatable body to allow inflation/deflation to the inflatable body via the air pump.

14. The inflatable product as claimed in claim 12, wherein the exchanging chamber has a first hole to communicate the exchanging chamber with the interior of the casing, a second hole to communicate the exchanging chamber with an interior of the inflatable body and a third hole, wherein an air tube extends from the third hole to communicate with the airway of the casing such that the sliding block is able to alternately block the first hole to communicate the second hole with the third hole via the exchanging chamber for inflation/deflation.

15. The inflatable product as claimed in claim 11, wherein a tube in communication with the airway extends out of an outlet of the air pump for sensing the pressure inside the inflatable body.

16. The inflatable product as claimed in claim 15 further comprising a switching member connected to the casing to selectively communicate an interior of the switching member with an interior of the inflatable body to allow inflation or deflation to the inflatable body via a pump.

17. The inflatable product as claimed in claim 16 further comprising an exchanging chamber connected to the casing and having a sliding block movably received inside the exchanging chamber to selectively communicate an interior of the exchanging chamber with an interior of the inflatable body to allow inflation/deflation to the inflatable body via the air pump.

18. The inflatable product as claimed in claim 16, wherein the exchanging chamber has a first hole to communicate the exchanging chamber with the interior of the casing, a second hole to communicate the exchanging chamber with an interior of the inflatable body and a third hole, wherein an air tube extends from the third hole to communicate with the airway of the casing such that the sliding block is able to alternately block the first hole to communicate the second hole with the third hole via the exchanging chamber for inflation/deflation.

19. The inflatable product as claimed in claim 18 being adapted to be built-in the inflatable body.

20. The inflatable product as claimed in claim 4 further comprising a load adjusting assembly connected to the driving element to adjust position of the driving element relative to the casing as well as the compression of the recoil element so that a force required to move the resilient element is changed in response to the position adjustment of the driving element.

21. The inflatable product as claimed in claim 1, wherein the recoil element is a leaf spring.

22. The inflatable product as claimed in claim 1 further comprising a load adjusting assembly connected to the driving element to adjust position of the driving element relative to the casing as well as the compression of the recoil element so that a force required to move the resilient element is changed in response to the position adjustment of the driving element.

23. The inflatable product as claimed in claim 1 further comprising an electrical connector positioned to electrically connect to the on/off switch.

24. The inflatable product as claimed in claim 1 being an inflatable air mattress.

25. The inflatable product as claimed in claim 1 being adapted to be built-in the inflatable body.

* * * * *